United States Patent [19]

Fushimoto

[11] 4,430,935

[45] Feb. 14, 1984

[54] PRINTER

[75] Inventor: Hideo Fushimoto, Kawasaki, Japan

[73] Assignee: Canon Kabushiki Kaisha, Tokyo, Japan

[21] Appl. No.: 256,039

[22] Filed: Apr. 21, 1981

[30] Foreign Application Priority Data

May 9, 1980 [JP] Japan ..... 55-61276

[51] Int. Cl.[3] ..... B41J 7/00

[52] U.S. Cl. ..... 101/93.11; 400/154.2; 101/205

[58] Field of Search ..... 101/93.11, 205, 110; 400/147, 148, 154.2, 154.5, 470, 471

[56] References Cited

U.S. PATENT DOCUMENTS

| | | | |
|---|---|---|---|
| 3,760,925 | 9/1973 | Bossi | 101/93.16 |
| 4,011,811 | 3/1977 | Kodis | 101/93.11 |
| 4,027,764 | 6/1977 | Kashio | 400/154.5 |
| 4,051,942 | 10/1977 | Suzuki et al. | 101/93.16 |
| 4,210,917 | 7/1980 | Lane | 400/470 |
| 4,250,807 | 2/1981 | Kondo et al. | 100/93.09 |

FOREIGN PATENT DOCUMENTS

| | | | |
|---|---|---|---|
| 2830226 | 1/1979 | Fed. Rep. of Germany | 101/93.09 |

*Primary Examiner*—Robert A. Hafer
*Assistant Examiner*—Bradley M. Lewis
*Attorney, Agent, or Firm*—Fitzpatrick, Cella, Harper & Scinto

[57] ABSTRACT

A serial printing apparatus is disclosed which has rotatable and axially slide-movable type wheels and means for supplying differently colored inks to the respective type wheels. The improvement in the printing apparatus made by the present invention comprises the provision of axially slide-movable hammers disposed opposed to the respective type wheels. Printing in different colors is performed by the hammers.

7 Claims, 4 Drawing Figures

PRINTER

BACKGROUND OF THE INVENTION

1. Field of the Invention

The present invention relates to a printer and in particular to a printer of serial type in which printing is carried out while moving the type wheel in the direction of line. More particularly, the present invention relates to a printer with which printing in different colors is possible employing ink rollers.

2. Description of the Prior Art

In the art there are known printers in which characters can be printed on a common paper and different kinds of data can be printed in different colors. An example of such printer is a printer associated with an electronic table calculator in which data of addition and data of subtraction are printed in black ink, and red ink respectively, so as to make the former data distinguishable from the latter.

However, most of the known printers capable of two color printing use ink ribbons in the form of a tape. This ink ribbon system involves some drawbacks. Firstly, it needs a separate driving apparatus to drive the ink ribbon. Secondly, it is large in size because of the provision of the separate ink ribbon driving mechanism. Thirdly, the driving apparatus increases the consumption of electric power in the printer.

To obviate the above drawbacks of large size and high power consumption there has already been proposed a printer of so-called ink roller type. In the roller type of printer an ink roller containing ink is used. The ink roller is in pressure-contact with a type wheel carrying a number of types on the circumference of the wheel. When the type wheel is rotated, the ink roller also rotates depending on the rotation of the type wheel. During the rotation, the ink roller applies ink to the types on the wheel. A hammer or the like strikes the type wheel through a printing paper to effect printing.

For this ink roller type printer it is no longer necessary to provide a particular driving mechanism to drive the ink roller. Since the type part of the type wheel can be formed of elastic material, the hammer need not have large impact force. As a result, the power consumption in the printer is substantially reduced as compared with the above ink ribbon type printer.

However, unlike the ink ribbon system, the ink roller system has not been useful for two color printing. As described above, in the case of the ink roller type printer, ink is directly applied onto the types on the type wheel and a printing paper is impacted against the types by a hammer or the like. If two different colored inks are applied to one and same type one after the other, no acceptable printing may be obtained. Therefore, it is common knowledge that two color printing is difficult to do employing the ink roller type system. For this reason, prior to the present invention, man has been compelled to use an ink ribbon type of printer in an electronic device which is designed for two color printing although it has the disadvantages of large size and large power consumption.

SUMMARY OF THE INVENTION

Accordingly, it is the primary object of the invention to provide an ink roller type of printer which enables two color printing without losing the advantages of a compact structure and low power consumption.

To attain the object according to the invention there is provided a printer comprising two type wheels, two ink rollers and two hammers. Each ink roller is in pressure-contact with a separate type wheel and rotatable while keeping the contact with the type wheels. The two type wheel are moved together in the direction of a line and each hammer is disposed opposed to a separate type wheel. The hammers are also movable in the direction of a line in synchronism with the movement of the type wheels. A printing paper is interposed between the type wheels and the hammers. For one printing motion, a selected one of the two hammers is driven to press the printing paper against one of the type wheels. Since the two ink rollers contain different inks with each ink in different color, two color printing is performed by selectively driving the two hammers one by one.

Other and further objects, features and advantages of the invention will appear more fully from the following description taken in connection with the accompanying drawings.

DESCRIPTION OF PREFERRED EMBODIMENTS

Figure 1:
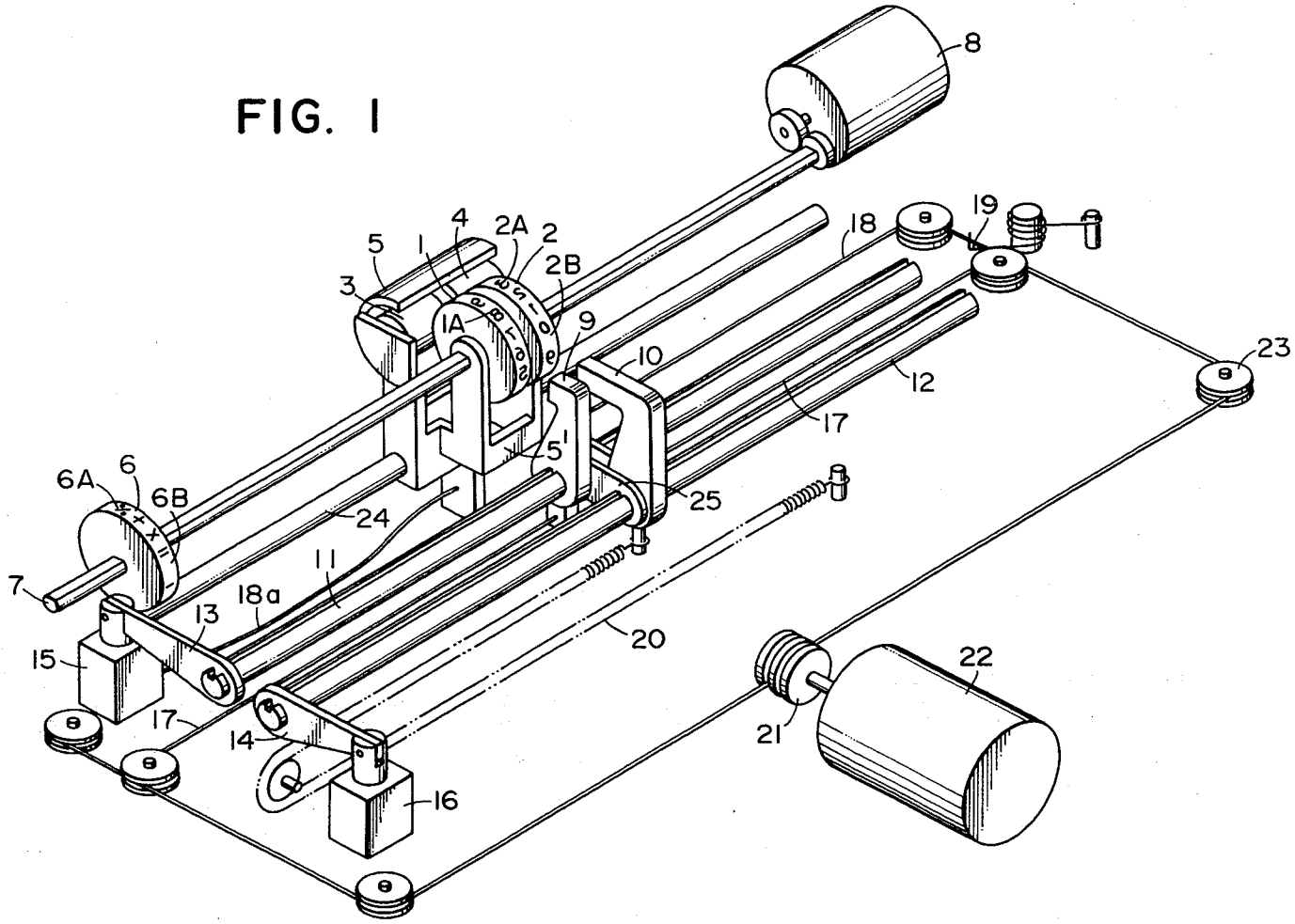
FIG. 1 is a perspective view of a printer showing an embodiment of the invention.

Referring first to FIG. 1 showing an embodiment of the present invention, a first type wheel and a second type wheel are designated by 1 and 2, respectively. Designated by 3 and 4 are a first ink roller and a second ink roller. 5 is an ink case and 6 is a stationary symbol type wheel for printing symbols and marks.

The type wheels 1, 2 and 6 are mounted on a type wheel rotating shaft 7 which is in turn driven by a pulse motor 8. The shaft 7 is driven into rotation in a well-controlled manner so that it can be stopped at any selected rotational position. Of the three type wheels the symbol type wheel 6 is fixedly mounted on the left-hand end portion of the shaft 7 and therefore the type wheel 6 is not slide movable along the shaft extending in the direction of line. The first and second type wheels 1 and 2 for printing numeral characters are slide movable along the shaft 7. The type wheels 1 and 2 are connected together to form a unit the rotation of which is controlled by the pulse motor 8 through the shaft.

The first and second ink rollers 3 and 4 are rotatably received in the ink case 5 and are disposed in pressure contact with the first and second type wheels 1 and 2, respectively. The ink fed to the first ink roller 3 and that to the second one 4 are different from each other in color. Carriage 5' is mounted for slide movement on a rail 24 and is integrally connected to the ink case 5. A type wheel connecting cord 18 is fastened to the lower portion of the carriage. The cord 18 extends from its one end at one side of the lower portion of the carriage to the other end at the other side of the lower portion through rollers 23 and a pulley 21. The pulley 21 is mounted on the output shaft of a pulse motor 22. Therefore, the type wheels 1 and 2 and the ink rollers 3 and 4 can slidingly be moved together forward and backward in the direction of line by the pulse motor 22 through the connection cord 18 and carriage 5'. Also, they can be stopped together at any selected position by suitably controlling the pulse motor 22.

A first hammer 9 is mounted on a first hammer driving shaft 11. The first hammer 9 is slide movable along the driving shaft 11 but fixed against rotation about the shaft by a slot provided therein. Mounted on the left-hand end of the driving shaft 11 is a first hammer driving plate 13 the other end of which is connected with a first hammer driving plunger 15. Although not shown, a printing paper is fed into the space between the hammers and the type wheels. When the first hammer 9 is driven by the first hammer driving plunger 15 through the first hammer driving plate 13, the hammer 9 presses the printing paper against the first type wheel 1 to effect printing. To move the first hammer 9 along the shaft 11 by the pulse motor 22, a hammer connecting cord 17 is fastened to the lower portion of the hammer 9.

A second hammer 10 opposed to the second type wheel 2 is slidingly mounted on a second hammer driving shaft 12. The second hammer 10 is driven by a second hammer driving plunger 16 through a second hammer driving plate 14 so as to press the printing paper against the second type wheel 2. The second hammer 10 is biased by a tension spring 20 fastened to the lower portion of the hammer 10. Normally the tension spring 20 intends to move the second hammer along the shaft 12 leftwards as viewed on the drawing of FIG. 1. Between the first and second hammers 9 and 10 there is interposed a subsidiary plate 25 so formed as to embrace the second hammer 10. The subsidiary plate 25 slides along the shafts 11 and 12. When the first hammer 9 is moved rightwards along the shaft 11 by the pulse motor 22 through the cord 17, the first hammer pushes and moves the subsidiary plate 25 together with the second hammer 10 also rightwards against the force of the tension spring 20. Thus, the second hammer 10 is moved along the shaft 12 rightwards interlocked with the first hammer 9. On the contrary, when the second hammer 10 is moved along the shaft 12 leftwards by the spring 20, the subsidiary plate 25 pushes and moves the first hammer 9 also leftwards. Therefore, the first hammer 9 slides along the shaft 11 leftwards interlocked with the slide movement of the second hammer 10.

In the shown embodiment, the first hammer 9 is used also to print symbol characters on the printing paper by the symbol type wheel. Namely, the first hammer 9 is common to the two type wheels 1 and 6. To this end, the type wheel connecting cord 18 is slackened as shown at 18*a* so that during the first step of a driving rotation of the pulse motor 22, only the hammer 9 may slide leftwards through the hammer connecting cord 17 while carriage 5' remains stopped.

Designated by 19 is a torsion coil spring whose function will be described later.

The manner of operation of the printer is as follows.

Figure 2:
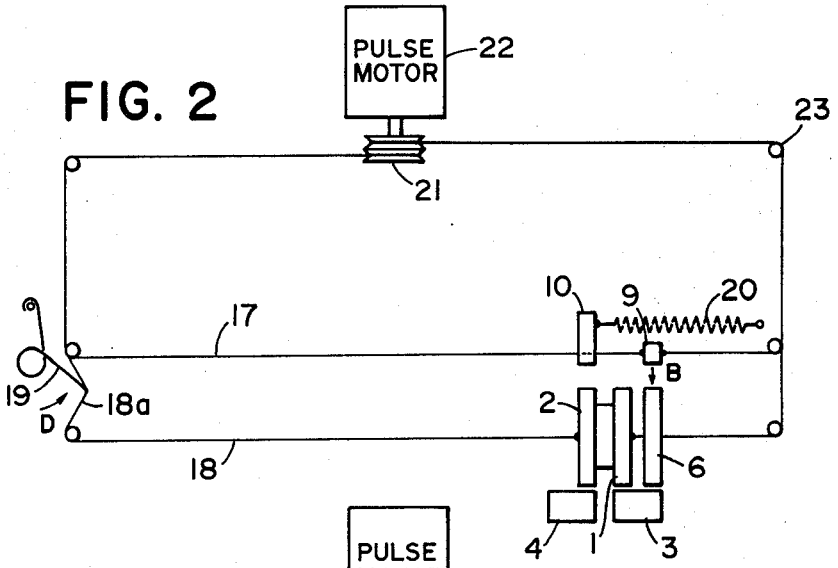
FIGS. 2 through 4 illustrate the manner of operation of the printer in a simplified form of illustration.

FIG. 2 schematically shows the printer in its starting position. Printing operation must be started from the shown position irrespective of which one of the first and second color inks is selected.

In this starting position, the first hammer 9 is held in the position opposed to the symbol type wheel 6 whereas the second hammer 10 is in the position opposed to the second type wheel 2. The position of the second hammer is the position to which the second hammer has been returned by the tension spring 20.

The first ink roller 3 is in contact with both of the first type wheel 1 and the symbol type wheel 6. The second ink roller 4 is in contact with the second type wheel 2. The type wheel connecting cord 18*a* has a slack 18' in an amount corresponding to one digit shift. The slackened portion 18*a* is brought into a tensioned state by the force D of the torsion coil spring 19 as illustrated in FIG. 2. The type wheel connecting cord 18 and the hammer connecting cord 17 are turned around the pulley 21 of the pulse motor 22 through rollers 23 so that the first hammer 9 and the first and second type wheels 1 and 2 can slide with the rotation of the pulley 21.

Figure 3:
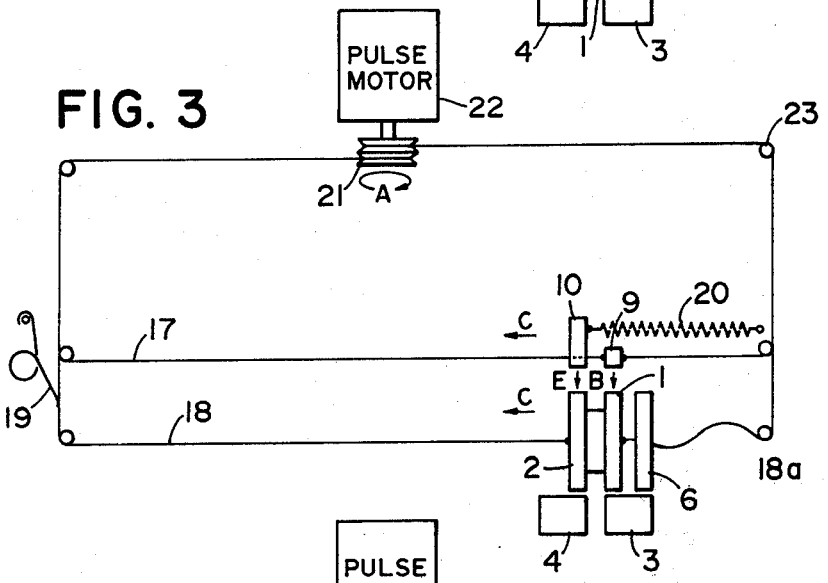
Figure 4:
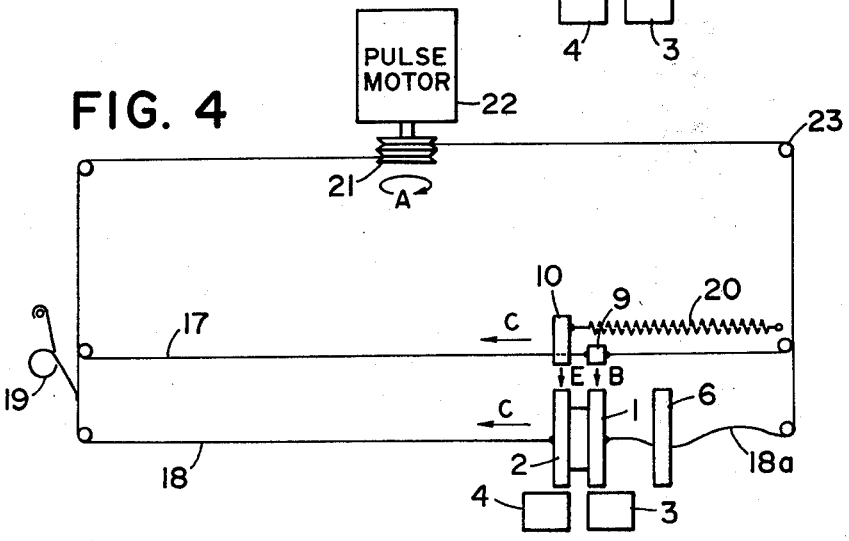

In the above starting position, a print instruction is delivered to the printer. In response to the print instruction, the type wheel rotating pulse motor shown in FIG. 1 starts to rotate. After rotated up to a determined position, the pulse motor 8 stops. At the same time, the first hammer driving plunger 15 is powered to move the first hammer 9 in the direction of arrow B in FIG. 2. The first hammer 9 impacts the printing paper (not shown) against a certain selected type on the symbol type wheel 6 for effecting symbol printing. After completing the symbol printing, the pulse motor 22 begins to rotate so as to make the first hammer 9 slide leftwards by one digit distance through the hammer connecting cord 17. At this time, since the type wheel connecting cord 18 merely pushes the torsion coil spring 19 in the direction opposite to D, the first and second type wheels 1 and 2 can not slide and therefore remain stopped in the starting position. Therefore, after the symbol printing, the printer takes a position as shown in FIG. 3. The first hammer 9 is in opposition to the first type wheel 1. The slack 18*a* moved through the pulley 21 is at the other end of the cord 18 shown in FIG. 3. In this position, the type wheel rotating pulse motor 8 selects any desired numeral type on the first type wheel and then the latter is stopped. The first hammer driving plunger 15 is powered simultaneously to drive the first hammer 9 in the direction of arrow B in FIG. 3. The first hammer presses the printing paper against the selected type on the first type wheel 1. Thus, a numeral character is printed on the printing paper with the selected type. After printing of the first numeral character, the hammers 9 and 10 and the type wheels 1 and 2 are moved together by one digit distance in the direction of arrow C while keeping the hammers 9 and 10 in opposition to the type wheels 1 and 2, respectively. Then, a second selected numeral character is printed on the printing paper by the first hammer 9 in the same manner as above. This printing operation is repeated sequentially while moving the hammers 9, 10 and the type wheels 1, 2 digit by digit in the direction of arrow C as shown in FIG. 4.

When printing of numeral character is to be made with the other color ink contained in the second ink roller 4, the pulse motor 8 selects a desired type on the second type wheel 2 and the second hammer driving plunger 16 is powered. The powered plunger 16 rotates the second hammer driving shaft 12 through the second hammer driving plate 14. Thus, the second hammer mounted on the shaft 12 is moved in the direction of arrow E to strike the second type wheel 2 through the printing paper. In this manner, printing of numeral characters in the color is performed.

At the end of one line of printing performed in the above described manner, the pulse motor 22 is reversed to move the first and second type wheels 1 and 2 rightwards. Therefore, the type wheels 1 and 2 are returned to their starting positions. Simultaneously with returning of the type wheels 1 and 2, the first and second hammers 9 and 10 are also moved rightwards by the spring 20 and returned back to their starting positions. Following the returning motion, the printing paper is advanced by one line and printing of the next line is carried out in the manner described above.

Referring again to FIG. 1, each type wheel has a blank type indicated by 1B, 2B, and 6B. During printing of a selected type 1A, 2A or 6A on one type wheel 1, 2 or 6, the other type wheels have blank types 1B, 2B, 6B facing the printing paper to prevent the paper from being made dirty during printing.

As readily understood from the foregoing, the present invention has realized an ink roller type of printer capable of printing in two different colors. Two type wheels and two hammers opposed to the two type wheels are provided so as to slide. Ink rollers containing different color inks are in contact with the two type wheels so that printing in two different colors can be effected by selectively driving the hammers.

While there has been described a preferred embodiment of the invention, obviously modifications and variations are possible in the light of the above teachings. It is therefore understood that within the scope of the claims, the invention may be practiced otherwise than as specifically described.

What I claim is:

1. A serial printer comprising:

a first shaft;

a first type wheel rotatable around and movable along said shaft;

a first ink roller for bearing a first color ink and adapted to be in contact with and to be moved together with said first type wheel and along said shaft;

a second type wheel rotatable around and movable along said shaft;

a second ink roller for bearing a second color ink different in color from the first color ink and adapted to be in contact with and to be moved together with said second type wheel and along said shaft;

first hammer means opposing to said first type wheel and movable along a second shaft having a different axis than said first shaft;

second hammer means opposing to said second type wheel and movable along a third shaft having a different axis than said first and said second shafts;

single motor means for simultaneously moving said first and second type wheels and said first and second ink rollers along said first shaft and said first and second hammer means along said respective second and third shafts;

first driving means for driving said first hammer means; and second driving means for driving said second hammer means.

2. A serial printer according to claim 1, further comprising a third type wheel rotatable around said first shaft for bearing either of the first or second color inks.

3. A serial printer according to claim 1, further comprising spring means for returning said first and second hammer means to their respective original positions.

4. A serial printer comprising:

first hammer means movable along a first shaft;

second hammer means movable along a second shaft;

first and second type wheels rotatable around and movable along a third shaft and adapted to be opposed to said first and second hammer means, respectively; and a member connected to said first and second hammer means, whereby when either said first or second hammer means is moved, the other of said first and second hammer means is forced by said member to be moved, thus said first and second hammer means are moved together.

5. A serial printer according to claim 4, wherein said first and second hammer means and said first and second type wheels are driven by a single motor.

6. A serial printer according to claim 4, wherein said first and second type wheels are associated with a first and second ink rollers bearing different color inks, respectively.

7. A serial printer according to claim 4, which further comprises a first and second electromagnetic means for energizing said first and second hammer means, respectively.

* * * * *

UNITED STATES PATENT AND TRADEMARK OFFICE

CERTIFICATE OF CORRECTION

PATENT NO. : 4,430,935

DATED : February 14, 1984

INVENTOR(S) : HIDEO FUSHIMOTO

It is certified that error appears in the above-identified patent and that said Letters Patent is hereby corrected as shown below:

Col. 1, line 54, insert --the-- before "same".

Col. 2, line 4, insert --is-- before "rotatable";

line 5, change "wheels" to --wheel--; and change "the contact" to --in contact--;

line 6, change "wheel" to --wheels--;

line 15, insert --a-- before "different".

Col. 3, line 67, change "18a" to --18--; and change "18' " to --18a--.

Col. 4, line 24, change "can not" to --cannot--.

Col. 5, line 20, delete "the" before "light".

UNITED STATES PATENT AND TRADEMARK OFFICE

CERTIFICATE OF CORRECTION

PATENT NO. : 4,430,935

DATED : February 14, 1984

INVENTOR(S) : HIDEO FUSHIMOTO

It is certified that error appears in the above-identified patent and that said Letters Patent is hereby corrected as shown below:

Col. 6, line 36, delete "a".

Signed and Sealed this

*Twenty-fourth* Day of *July 1984*

[SEAL]

*Attest:*

GERALD J. MOSSINGHOFF

*Attesting Officer*

*Commissioner of Patents and Trademarks*